US008211251B2

(12) United States Patent
Carsley et al.

(10) Patent No.: US 8,211,251 B2
(45) Date of Patent: Jul. 3, 2012

(54) LOCAL HEAT TREATMENT OF ALUMINUM PANELS

(75) Inventors: John E. Carsley, Clinton Township, MI (US); Chih-Cheng Hsu, Rochester Hills, MI (US); Susan E. Hartfield-Wunsch, Livonia, MI (US); Theresa M Lee, Lake Orion, MI (US); James G. Schroth, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 12/541,441

(22) Filed: Aug. 14, 2009

(65) Prior Publication Data

US 2011/0036472 A1 Feb. 17, 2011

(51) Int. Cl.
*C22F 1/04* (2006.01)

(52) U.S. Cl. ..... 148/694; 148/698

(58) Field of Classification Search ..... 148/688–704
See application file for complete search history.

(56) References Cited

U.S. PATENT DOCUMENTS

| | | | | |
|---|---|---|---|---|
| 3,135,633 | A * | 6/1964 | Hornus | 148/695 |
| 3,899,370 | A * | 8/1975 | Takahashi et al. | 148/518 |
| 5,728,241 | A | 3/1998 | Gupta et al. | |
| 6,406,571 | B1 * | 6/2002 | Gupta et al. | 148/697 |

OTHER PUBLICATIONS

"Aluminum and Aluminum Alloys: Modeling and Simulation of the Forming of Aluminum Sheet Alloys" p. 1-45 (2007).*

* cited by examiner

*Primary Examiner* — Roy King
*Assistant Examiner* — Janelle Morillo
(74) *Attorney, Agent, or Firm* — Dierker & Associates, P.C.

(57) ABSTRACT

A method of accomplishing precipitation hardening of a selected portion of an aluminum panel is disclosed herein. The method includes identifying at least one area of the aluminum panel that experiences thermal stress above a threshold value during a bake cycle, thereby identifying the selected portion. Prior to the bake cycle, the method further includes locally heating the selected portion at a predetermined temperature for a predetermined time sufficient to increase a local yield strength of the selected portion such that the increased local yield strength ranges from 150 MPa to 300 MPa.

16 Claims, 6 Drawing Sheets

LOCAL HEAT TREATMENT OF ALUMINUM PANELS

TECHNICAL FIELD

The present disclosure relates generally to local heat treatment of aluminum panels.

BACKGROUND

Aluminum roof panels have been used in automobiles in order to improve vehicle performance and fuel economy. One challenge in implementing aluminum roof panels is joining the panel to a steel, or other non-aluminum, body structure. In order to achieve suitable joining of the parts, the roof is often riveted and then bonded to the body. This assembly undergoes a paint bake process during the manufacture of such automobiles. In the paint bake process, the assembled automobile body goes through three bake ovens to cure the previously applied paint.

SUMMARY

A method of triggering precipitation hardening of a selected portion of an aluminum panel is disclosed herein. The method includes identifying at least one area of the aluminum panel that experiences thermal stress above a threshold value during a bake cycle, thereby identifying the selected portion. Prior to the bake cycle, the method further includes locally heating the at least one selected portion up to a predetermined temperature for a predetermined time sufficient to increase a local yield strength of the at least one selected portion such that the increased local yield strength ranges from 150 MPa to 300 MPa. Also disclosed herein is a system for applying local heat treatment to aluminum panels.

BRIEF DESCRIPTION OF THE DRAWINGS

Features and advantages of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Embodiments of the method disclosed herein advantageously result in aluminum parts having locally increased yield strength, such that the parts are suitable for undergoing various subsequent processes (e.g., paint bake processes). The process disclosed herein allows one or more portions of the aluminum part/panel, which may be susceptible to thermal distortion or deformation resulting from a subsequent heating process (e.g., a paint bake process), to be identified and treated prior to such subsequent heating process(es). The pre-treatment process triggers precipitation (i.e., a phase change based on diffusion of constituents through the structure that strengthens the aluminum to a T8X temper condition) within the aluminum. This is particularly desirable because the material is strengthened to a level above the thermally-induced stress levels produced by the subsequent heating process. When the aluminum parts/panels are treated via the methods disclosed herein, they are strengthened such that the thermal stresses during the subsequent heating process(es) remain in the elastic regime, and thus permanent deformation does not result.

One advantage of the methods disclosed herein is that the aluminum parts/panels are treated prior to being joined to another part, which is often formed of another material (e.g., steel). As such, it is believed that any potentially deleterious results due to thermal expansion of the different materials may be overcome using the methods disclosed herein.

Figure 1:
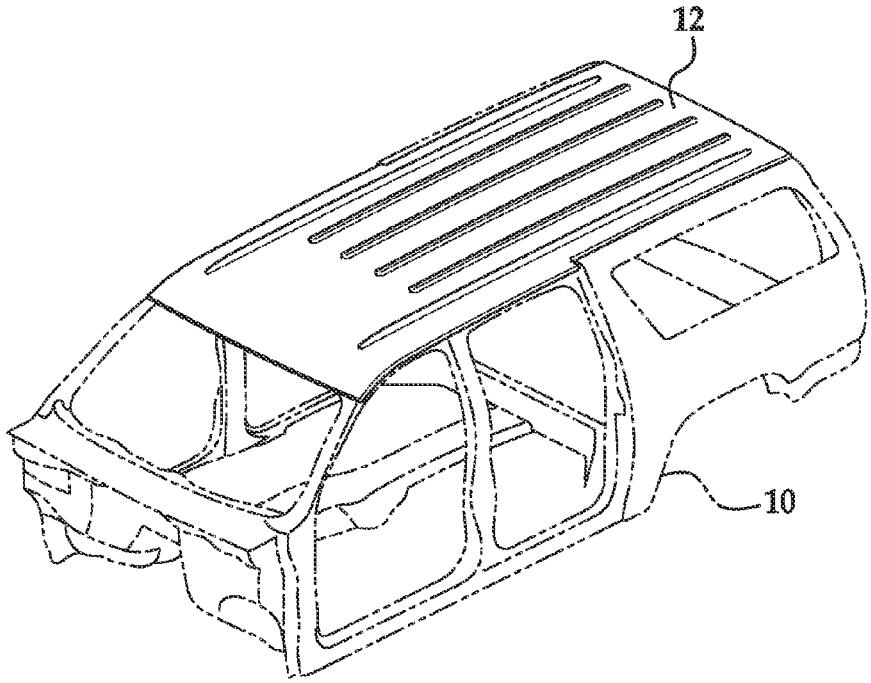
FIG. 1 is a perspective view of an automobile steel body structure (in phantom) with an attached aluminum alloy roof panel.

Referring now to FIG. 1, a schematic depiction of a vehicle body 10 fitted with an aluminum roof panel 12 is shown. The vehicle body 10 in this example resembles a Chevrolet® Suburban. In one embodiment, the vehicle body 10 is formed of steel, and the aluminum roof panel 12 is formed of aluminum or an aluminum alloy. The aluminum panel 12 may include a precipitation hardening aluminum alloy selected from age-hardenable aluminum alloys such as Al—Mg—Si (6xxx series), Al—Mg—Si—Cu (2xxx series), or combinations thereof. It is to be understood that the aluminum panel 12 may be formed of any other age-hardenable aluminum. In one non-limiting embodiment, the aluminum panel 12 includes a precipitation hardening aluminum alloy which includes from 0.5 weight percent to 3.0 weight percent of non-aluminum metals. Such metals may be selected from copper, iron, magnesium, manganese, silicon, titanium and combinations thereof.

Furthermore, while a roof panel is shown in FIG. 1 and referred to herein in accordance with the various embodiments and examples, it is to be understood that any other aluminum parts/panels 12 may be treated via the process disclosed herein. As such, the aluminum part/panel 12 selected may be suitable for use in any industry, including automotive or non-automotive industries. Furthermore, the design of the panel 12 shown in the Figures is not limiting. It is to be understood that the panels 12 may be designed differently, and that such design changes may include, for example, visible feature lines (such as stiffening beads) (not shown) that would stiffen at least key portions of the panel 12.

As discussed herein, one embodiment of the method involves the local rapid heating of the bare panel(s) 12. This may be desirable in order to eliminate the possibility of downstream problems due, at least in part, to the presence of additional coatings. However, in another embodiment, the panel(s) 12 may have a coating applied thereto, which increases the surface emissivity of the bare panel 12 and improves the rate of heat transfer by radiation. The emissivity parameter ranges from 0 to 1.0. For bare aluminum, the surface emissivity is very small (e.g., on the order of 0.05). Any coating may be applied that renders the underlying surface rougher, darker, and less reflective. In one example, a boron nitride coating is used. Other suitable coatings may include black or colored paint or graphite powder that will increase emissivity compared to the shiny aluminum surface. The applied coating generally has a thickness that obscures the shiny surface of the panel 12, but does not act as a thermal insulator. The thickness may also depend upon the characteristics of the material to be coated. Such a coating may be applied with any suitable technique, such as, for example, painting techniques (spray, brush, roller, etc.), dipping techniques, electrostatic plating processes, flame spraying, vapor deposition (physical or chemical), or the like.

In still other instances, the bare panel(s) 12 surface may be roughened (e.g., with Scotch-Brite® (available from 3M) or sandpaper).

The method disclosed herein involves initially identifying at least one area of the aluminum panel 12 that experiences thermal stress above a threshold value during a bake cycle (e.g., a paint bake cycle or some other heat treatment process). This may be accomplished by actually exposing a sample panel 12 to the conditions of the bake cycle, or via computer-aided engineering (CAE) analysis. Using CAE analysis enables the simulation of the process of the bake cycle where the temperature of the entire vehicle (i.e., body 10 and panel 12) is raised to the bake temperature, and the resultant thermal stresses and/or thermal strains are calculated. The simulation corresponds with the modeled condition which reflects the stresses and/or strains produced during the manufacturing process. The resultant thermal stresses and strains are caused by the difference in thermal expansion behavior of the two dissimilar materials. In one example, the coefficient of thermal expansion for aluminum is approximately double that of steel, so for a given increase in temperature, the aluminum would expand twice as much as would the steel. In this example, because the aluminum is constrained around its periphery to the steel structure, the extra aluminum expansion is accommodated by distorting the panel 12. Such distortion could cause a permanent shape change if the thermal strains exceed the elastic limit of the aluminum. However, if the distortion remains elastic, then the original shape may be restored upon cooling to room temperature.

Figure 2:
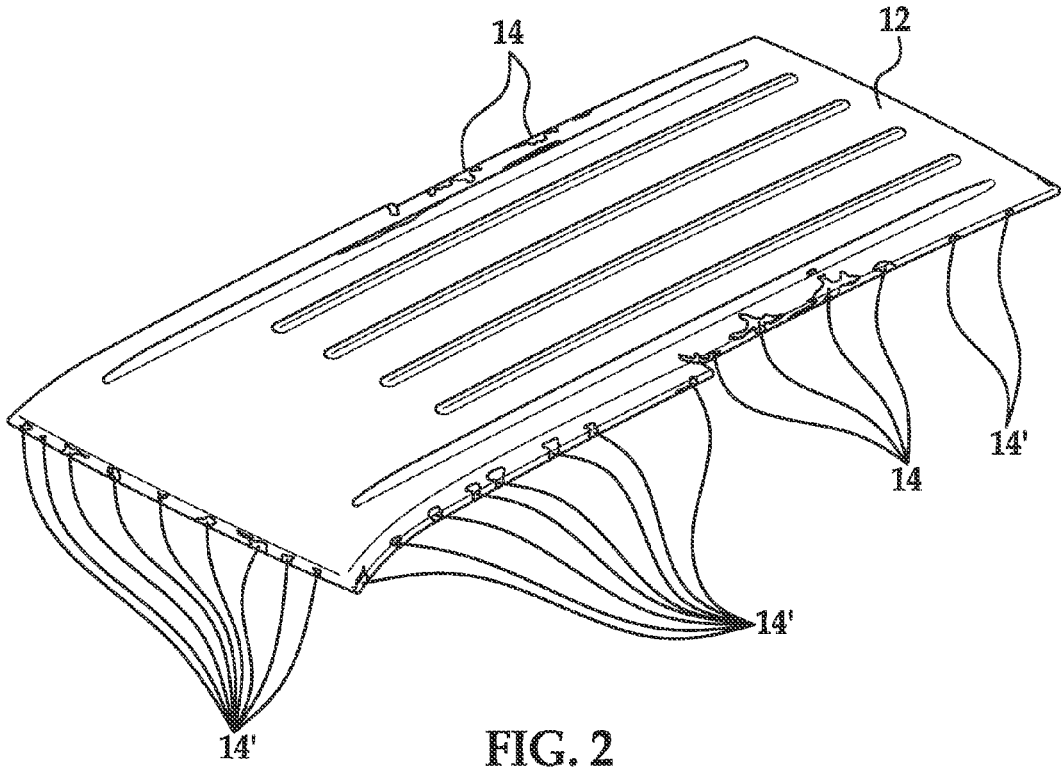
FIG. 2 is a schematic perspective representation of a contour plot indicative of stress distribution of an aluminum alloy roof panel during an oven bake cycle at 180° C.

FIG. 2 shows a schematic perspective view of the aluminum roof panel 12 of FIG. 1 in a paint bake oven environment at approximately 180° C. More particularly, this Figure is a schematic representation of a contour plot of the stress distribution of the aluminum panel 12 during the bake. The identified stress contour areas 14 and 14' are labeled in FIG. 2. Such stress contour areas 14, 14' are identified as those areas experiencing stress exceeding the yield strength (i.e., the threshold level) of the selected aluminum alloy during the baking process. The stress contour areas labeled 14' are located around the rivet locations in the final product, and may not be visible in the final product. Such stress contour areas 14' may or may not be selected for the local heat treatment process disclosed herein. In contrast, stress contour areas labeled 14 are visible in the final product, and the permanent distortion in these areas 14 generally result in an undesirable surface appearance. These stress contour areas 14 are selected for the local heat treatment process disclosed herein. Whether all of the stress contour areas 14, 14' or only those areas 14 that are visible in the final product are pre-treated depends upon the manufacturer or operator of the process. In this example, the aluminum alloy is AA6111-T4, and the identified stress contour areas 14 exceed the yield strength of 140 MPa (which is typical for this alloy).

Figure 3:
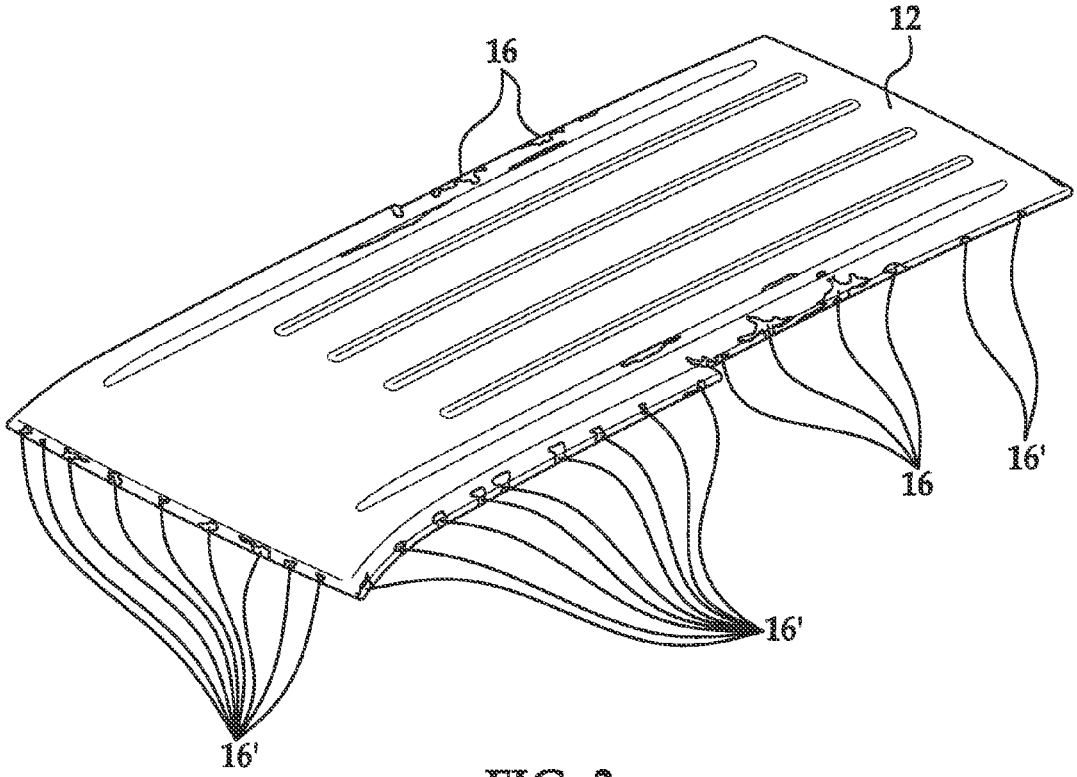
FIG. 3 is a schematic representation of a contour plot indicative of plastic strain of an aluminum alloy roof panel during an oven bake cycle at 180° C.

FIG. 3 shows another schematic perspective view of the aluminum roof panel 12 of FIG. 1 in the paint bake oven environment. More particularly, this Figure is a schematic representation of a contour plot of the plastic strain distribution of the panel 12 during the bake. The identified plastic strain areas 16 and 16' are labeled in FIG. 3. Such plastic strain areas are identified as those areas of potential permanent distortion. Similar to the stress contour areas 14', the plastic strain areas labeled 16' are located around the rivet locations in the final product, and may not be visible in the final product. Such plastic strain areas 16' may or may not be selected for the local heat treatment process disclosed herein. In contrast, plastic strain areas labeled 16 are visible in the final product, and the permanent distortion in such areas generally results in an undesirable surface appearance. These plastic strain areas 16 are selected for the local heat treatment process disclosed herein. Whether all of the plastic strain areas 16, 16' or only those areas 16 that are visible in the final product are pre-treated depends upon the manufacturer or operator of the process.

It is to be understood that when the selected portion(s) for local heat treatment are identified using CAE, either or both of the stress contour and strain contour plots may be used. One or both of the plots may be evaluated to identify the areas suitable for the pre-treatment process. These plots assist in identifying weak areas (e.g., 14 and 16) in the panel 12, which include those areas surrounding the region where the stress and/or plastic strain is beyond a predetermined threshold. Generally, the predetermined threshold for stress is the yield strength of the material, and the predetermined threshold for the strain is non-elasticity. While the stress and strain contour plots shown herein as schematic representations, it is to be understood that these gray-scale images represent one example of thermal stresses and strains. In actuality, the thermal stresses and strains occur as gradients on the surface of a panel 12. Such gradient natures are often represented by color coded plots, where each color of the plot may identify a different level of stress or strain.

Figure 4:
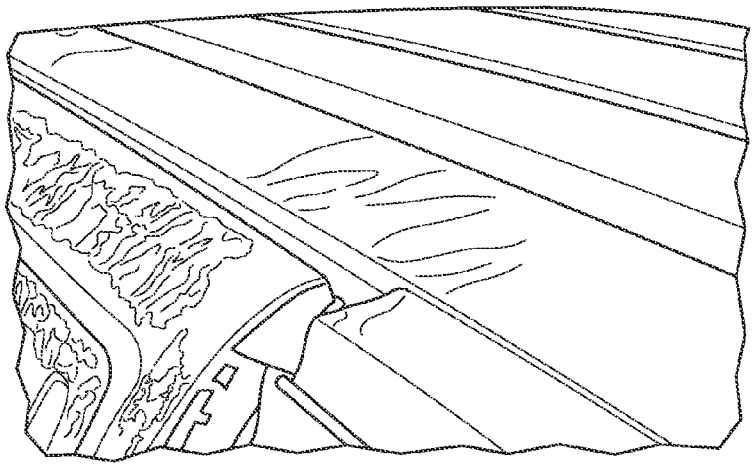
FIG. 4 is a schematic representation of a photograph of a portion of an automobile with a distorted aluminum alloy roof panel after a paint bake process, and without the pre-bake local heat treatment process described herein.

As previously mentioned, the at least one area (that experiences thermal stress above the threshold value during the bake process) may also be identified by exposing a sample panel 12 to the bake conditions (instead of via CAE). FIG. 4 is a schematic representation of a photograph of a Chevrolet®

Suburban aluminum roof panel 12 after it has been subjected to the bake process. FIG. 4 shows a schematic illustration of the actual distorted condition of the roof panel 12, and such distorted areas may be used to identify portions on other like samples that are to be treated with the local heat treatment disclosed herein.

Once the susceptible areas are identified, such areas are subjected to a local heat treatment in order to induce precipitation strengthening prior to any subsequent bake cycle(s) (e.g., a paint bake cycle/process). As mentioned hereinabove, precipitation is a phase change that strengthens the aluminum to a "T8X" temper condition. The original condition of the alloy sheet is referred to as T4 temper, and the desirable final condition of the alloy sheet is referred to as T8X temper. An aluminum alloy sheet has relatively low yield strength in T4 temper while having relatively high yield strength in T8X temper. As briefly discussed hereinabove, the T8X temper condition is more suitable for achieving performance requirements.

During precipitation, constituents diffuse throughout a material's microstructure. Such a diffusion state requires the affected material to be at a given temperature for a certain time. Thermal expansion instantaneously occurs with an increasing temperature, and the differences in thermal expansion between aluminum and, for example, steel, in traditional paint bake processes, often cause thermal stresses which lead to the previously described distortion. During traditional paint bake processes, such thermal stresses may exceed the elasticity limit of the aluminum before the desirable hardening (via precipitation) takes place to increase the aluminum's yield strength. As described and shown herein, locally heating the identified susceptible areas prior to a paint bake process triggers precipitation in such areas, resulting in a locally strengthened material that can withstand thermal stress during the subsequent bake process.

As such, the local heat treatment process is employed to specifically harden parts of the aluminum roof panel 12 before it goes through the paint bake cycle or another subsequent heating process. Those portions of the panel 12 which have been locally heat treated exhibit a greater yield strength than the untreated portions. In an embodiment, the heat treatment is accomplished by locally heating the selected portions (i.e., the pre-identified areas) up to a predetermined temperature and for a time sufficient to obtain a yield strength which ranges from 150 MPa to 300 MPa. The local heat treatment strengthens the treated portions of the panel 12 so that yield strength of the material increases above the thermal stresses placed upon those portions at the bake oven temperature. As a result of the greater yield strength, the thermal expansion of the locally hardened portions of the panel 12 during the subsequent paint bake process produces strains that remain elastic, and permanent distortion/deformation is avoided. Locally enhanced stiffness of the panel 12 in the pre-treated portions is also achieved by increasing the yield strength of the material.

Local heating may be accomplished via any suitable technique. As discussed further herein, the temperature, time and distance between the heat source and the portion of the panel 12 to be locally heated may be altered in order to achieve the desired yield strength. It is to be understood that such parameters may depend, at least in part, upon the material of the panel 12 and the heat source selected.

In a non-limiting embodiment, two methods of local heat treatment are particularly suitable for high volume production. Such techniques include infrared radiation (IR) heating and induction heating. Such methods can be adapted for use in a high volume automobile manufacturing process, with either in-line or batch-type procedures. Other non-limiting examples of suitable heat treatment processes that could be suitably engineered for local heating include conduction heating with a hot die surface, hot air convection heating, flame heating, laser beam heating, electron beam heating, microwave heating, magnetic flux heating, and resistance heating.

In an embodiment, a 1500 Watt IR lamp is used to achieve sufficient heat to obtain the yield strength ranging from 150 MPa to 300 MPa. However, it is to be understood that lamps of different powers may also be used to achieve equivalent results. For the 1500 Watt IR lamp, a "zero" gap distance may be used between the IR lamp and the surface of the panel portion to be locally heated. The zero gap distance refers to the placement of the 1500 W lamp such that it is very close to (e.g., 2 mm or less) the surface of the aluminum alloy roof panel 12 to be locally heated. In one embodiment when the zero gap is used, the lamp does physically touch the surface of the panel 12. In another embodiment when the zero gap is used, the lamp is close to, but does not physically touch the surface of the panel 12. As such, in one embodiment, the zero gap includes a gap distance ranging from 0 mm up to 50 mm. However, it is to be understood that with a more powerful IR source, the gap between the lamp and the panel 12 may be increased, and sufficient local heat will still be generated. Furthermore, if the time of heat exposure is varied, different results may be obtained using an IR lamp. For example, if less heating time is desired, a higher wattage lamp may be used in combination with a closer gap distance. Excessive IR lamp exposure may over-age the aluminum panel 12 portions, thereby softening the locally heated portions. Therefore, an appropriate combination of the variables of heating time and temperature, gap distance between the heat source and the surface of the panel 12, the angle of incidence of the heat on the surface, the emissivity of the panel 12, and the power of the heat source is necessary to achieve the desired increase in yield strength. As such, the examples set forth herein are merely illustrative, and it is contemplated that various combinations of the factors disclosed herein (e.g., heat time, temperature, gap distance, panel emissivity, incidence angle, power, etc.) may be used to achieve the desirable yield strength.

Figure 5A:
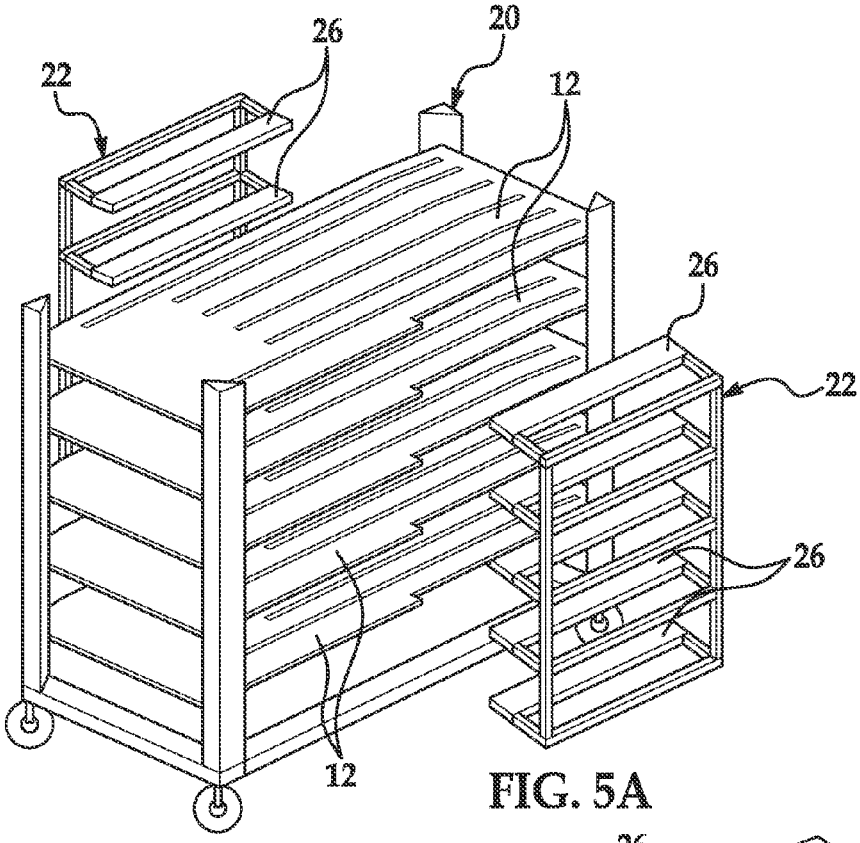
FIGS. 5A and 5B are schematic perspective representations of a heat treat rack holding several aluminum alloy panels prior to (FIG. 5A) and during (FIG. 5B) local heat treatment according to an embodiment of the present disclosure.
Figure 5B:
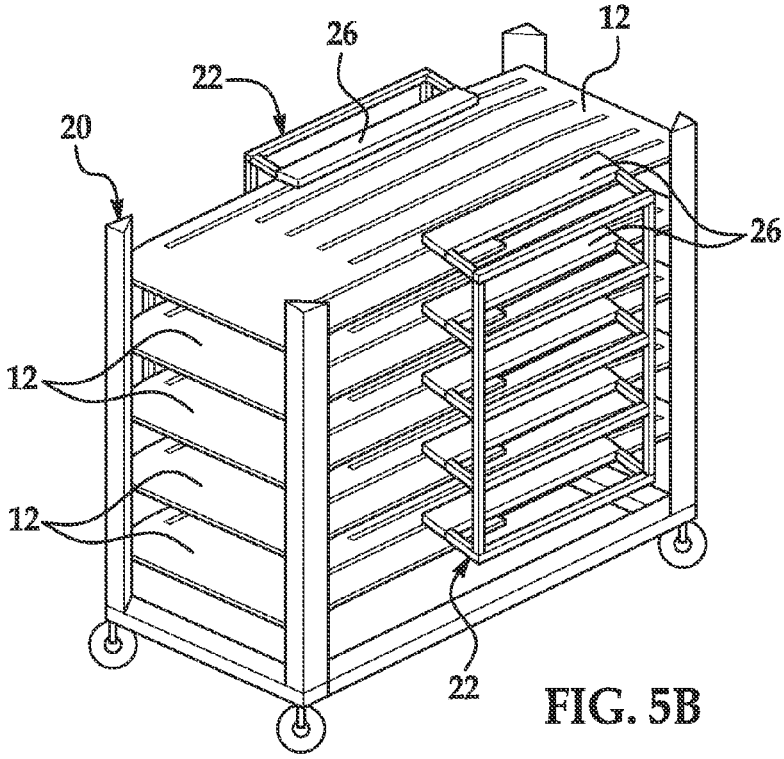
Figure 6:
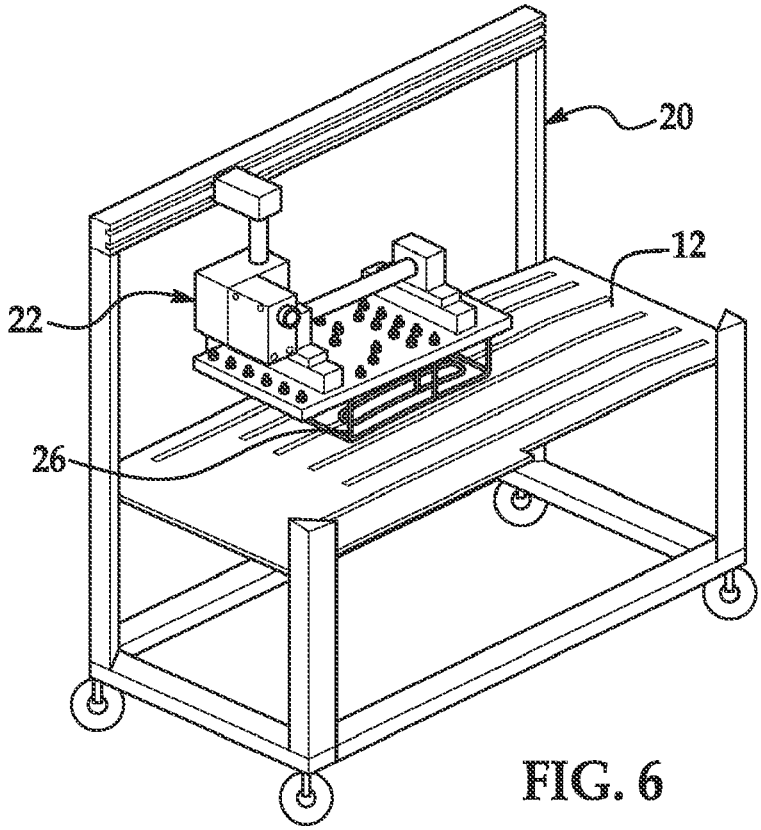
FIG. 6 is a schematic perspective representation of another heat treat rack holding an aluminum alloy panel during local heat treatment, the heat treat rack has the heat source formed integrally therewith.

In some instances, a heat treat rack may be used to hold the aluminum panel 12 in position during localized heating. FIGS. 5A, 5B and 6 illustrate examples of such heat treat racks 20 being used with different heat sources. In FIG. 5A, the heat treat rack 20 holds a plurality of aluminum alloy panels 12. The panels 12 are separated by a suitable distance so that a heat setup 22, including multiple heat sources 26, may be positioned so that each source 26 is capable of locally heating the selected portion of one of panels 12. When in position, as shown in FIG. 5B, the heat sources 26 (e.g., IR heat lamps or other heating units) of the setup 22 function at the same time, thereby heating the desirable portions of the respective panels 12 simultaneously. It is to be understood that the panels 12 may be positioned in any convenience or otherwise suitable location (e.g., vertically or at an angle), and that the positioning is not limited to the horizontal configuration shown in FIGS. 5A, 5B and 6. While an array of heat sources 26 that swing into position to heat treat the respective portions of an entire rack of panels 12 simultaneously is shown in FIGS. 5A and 5B, it is to be understood that the heat treat rack may be configured to hold a single aluminum panel 12. This may be desirable if production is on a smaller scale.

Another embodiment of a heat treat rack 20 is shown in FIG. 6. In this example, the heat treat rack 20 has the heat source 26 formed integrally therewith. The rack 20 holds the aluminum alloy panel 12, and the heat source 26 may be moved to a desirable position to accomplish local heat treatment. In this embodiment, the setup 22 includes induction coils as the heat source 26, and these induction coils are specifically shaped to align with the selected portions of the panel 12. While the embodiment shown in FIG. 6 illustrates an induction coil as the heat source 26, it is to be understood that another heating source may be used. The heat setup 22 is selected to provide an appropriate power supply and schedule for rapid heating of the portion of the panel 12. Furthermore, this embodiment of the heat treat rack 20 may be configured to hold and heat treat multiple panels 12 simultaneously.

The heat rack 20 and heat source(s) 26 shown in these Figures may be tuned to rapidly heat and hold any given temperature adjacent to specific area of the panel 12 for an extended duration. Such a process is well-suited for an in-line heat treatment during automobile production.

In other embodiments, localized heating of the identified portion(s) of each panel 12 may take place in an assembly line process. As one example, in automobile production, aluminum panels 12 may be heat-treated quickly one after another on an assembly line directly after the trimming operation. As another example, the roof panels may be heat treated in a batch operation prior to being assembled. More particularly, when new untreated panels 12 are obtained, each may be positioned in a respective empty station of a heat treat rack 20. The locally heat treated panels 12 may be prepared in accordance with the desirable assembly line rate (i.e., the heat treatments would be offset for each station) so that there is always a heat-treated panel ready to go into the functioning assembly line.

In still another embodiment, a heated die (not shown) may be used to locally heat the predetermined portion(s) of the panel 12. The heated die may have the shape of at least a part of the aluminum panel 12. For example, it is generally desirable that the heated die have the shape of the portion of the panel 12 to be locally heated. Bringing the panel 12 into intimate contact (i.e., with little or no gap therebetween) with the heated die provides conduction heat transfer to the local portion(s) of the aluminum panel 12 in a very short time. This embodiment may not be suitable for every panel 12, at least in part because of the risk that the direct contact may, in some instance, deleteriously affect the appearance of the outer surface quality of the local portions. As such, this embodiment may be more desirable for panels 12 that are not visible in the final product.

As previously mentioned, it is to be understood that a suitable operating window exists for each set of parameters, (time, gap, power, and temperature) used in the local heating process. In many instances, the time and/or temperature used will depend upon the gap distance and power selected. For example, if the gap between the heat source and the portion of the panel 12 is increased, it may be necessary to hold the heat source in such position for a longer time. In an embodiment, a smaller gap (e.g., equal to or less than 50 mm) is desirable so that less time is required to reach the desirable maximum temperature. It is believed that a small gap, in combination with a lower temperature and exposure time, reduces the risk of over-aging the portion(s) which renders the panel 12 more vulnerable to deleterious effects during the paint bake cycle. Generally, a consistent gap between the panel portion and the heat source has been found to ensure a robust process. This is due, at least in part, to the fact that a consistent gap leads to the formation of consistent properties being formed in the treated portions of the panel 12, thereby rendering such portions capable of withstanding subsequent baking cycles.

It has been found that the upper and lower limits for appropriate time and temperature conditions for the local heating process disclosed herein are between the known desirable conditions for traditional paint bake processes and those conditions which result in over-aging of the material. Known paint bake process conditions include heating for 30 minutes at 180° C. or heating for 25 minutes at 185° C. Such conditions are a compromise between the need to cure the paint adequately and the need to generally achieve sufficient precipitation hardening of the aluminum. It is also known that heating the panel for one minute at 325° C. over-ages the material and decreases yield strength. Generally, the time for the local heating should be sufficient to obtain yield strength from 150 MPa to 300 MPA when the temperature ranges from 180° C. to 325° C. As mentioned herein, the time may change if the gap distance is changed. The desirable yield strength can be achieved by heating the local portion of the panel 12 to 325° C. for approximately 15 second to approximately 30 seconds, and thus this is a suitable non-limiting upper boundary. The desirable yield strength can also be achieved by heating the local portion of the panel 12 to 300° C. for approximately 30 seconds to approximately 3 minutes. Similar results can also be achieved by heating the local portion of the panel 12 to 275° C. for approximately 1 minute to approximately 4 minutes. Similar results can also be achieved by heating the local portion of the panel 12 to 250° C. for approximately 2 minutes to approximately 10 minutes. Even at a temperature as low as 180° C., a suitable increase in yield strength can be obtained when the local portion of the panel 12 is heated at that temperature for approximately 30 minutes. These specific heating times and temperatures are believed to be suitable for localized heating of AA6111-T4PD aluminum alloy panels. It is to be understood that other age hardenable aluminum alloys may have slightly different time and temperature limits, which depend, at least in part, upon the composition of the material and the material's response to thermal exposure.

The specific times and temperatures may be achieved using an IR lamp, induction heating methods, conduction heating methods (such as, for example, direct, intimate, physical contact with a solid heat source which utilizes conduction heat transfer), or any of the other rapid heating methods described herein. Such techniques offer relatively quick heating rates which are particularly suitable for localized heating.

The selected parameters for localized heating may also depend upon the desirable production schedule. In some instances, the production schedule might dictate the use of faster cycle times, and thus a small gap and higher temperature may be utilized. However, a batch process using a heat rack device in which aluminum panels with heat treated local areas are accumulated separately from an in-line process provides the freedom of both longer exposure times and lower temperatures. An induction heating device would lend itself well to such a method, at least in part because it can heat the material up quickly to any temperature in the desired range and can maintain that temperature for an extended time needed. The IR lamp can locally heat the panel 12 portion(s) to a higher temperature (such as, e.g., 325° C.) but for a shorter period (e.g., about one minute), or can be used to produce a lower temperature for a longer duration when it is positioned further from the panel 12.

After the local heat treatment, the entire panel 12 is subjected to a subsequent heating process (e.g., a paint bake process). It is to be understood that after the localized pretreatment, a gradient in properties exists between the heat-treated portion(s) of the panel 12 and the non-heat treated portion(s). This gradient essentially disappears once the entire panel 12 undergoes the subsequent bake cycle. Since the susceptible areas of the panel 12 have been pre-treated via the methods disclosed herein, the bake cycle has no deleterious effects on the properties and microstructure of the panel 12. This is due, at least in part to the fact that the bake temperature of about 185° C. is not sufficient to over-age the panel 12 unless a very long exposure time (which depends, at least in part, upon the aluminum alloy) is used. Thus, the microstructure of the heat treated portion remains stable through the bake cycle.

To further illustrate embodiment(s) of the present disclosure, various examples are given herein. It is to be understood that these are provided for illustrative purposes and are not to be construed as limiting the scope of the disclosed embodiment(s).

EXAMPLES

Example 1

Figure 7:
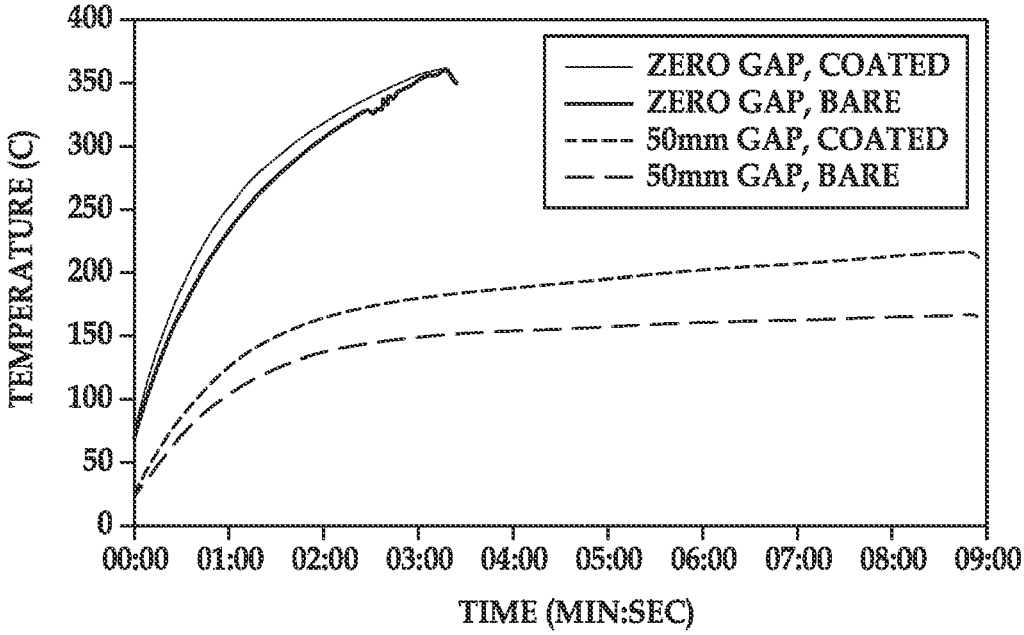
FIG. 7 is a graph plotting aluminum sample heating profiles (temperature as a function of time) for two different gap spacings between bare aluminum alloy samples or coated aluminum alloy samples and the heat source during a local heat treatment process.

Various aluminum alloy (i.e., AA6111-T4PD) samples were heated under specific conditions of time, temperature and proximity (i.e., gap distance) with a 1500 Watt IR lamp. Specifically, two aluminum samples were tested using the IR lamp with increasing times and temperatures at two different gap distances, namely a zero gap (i.e., nearly touching, less than 0.5 mm) and a 2-inch gap. The results are shown in FIG. 7. This graph plots the time of exposure to the IR lamp (in minutes) against the measured temperature of the aluminum samples (in degrees C.). According to results shown FIG. 7, the zero gap heated sample achieved a higher temperature (above 350° C.) at a much faster heating rate than did the 2-inch gap heated sample (above 150° C. maximum). Surface emissivity has a strong influence on the rate of heating by radiation. It is to be understood that the surface condition (and therefore emissivity) of these aluminum samples was not altered from the as received condition (i.e., the typical condition after the stamping process).

Another set of aluminum alloy samples were coated with boron nitride. The boron nitride was a powder suspended in a water solution, and was applied to the samples via rubbing. The water evaporated after application, leaving behind a coating of boron nitride powder that stuck to the surface of the aluminum alloy. This coating was applied to increase the emissivity of the aluminum alloy surface. The coating did not completely obscure the shiny aluminum and provided emissivity ranging from 0.15 to 0.30. These coated samples were also tested as described above using the IR lamp with increasing times and temperatures at the two different gap distances. As shown in FIG. 7, with the zero gap, there was no significant difference in heating rate. However, with the 2-inch gap, the coated samples heated much faster than the bare aluminum alloy samples. As shown in FIG. 7, the difference in heating rate diminished approximately linearly as the gap was reduced.

Figure 8:
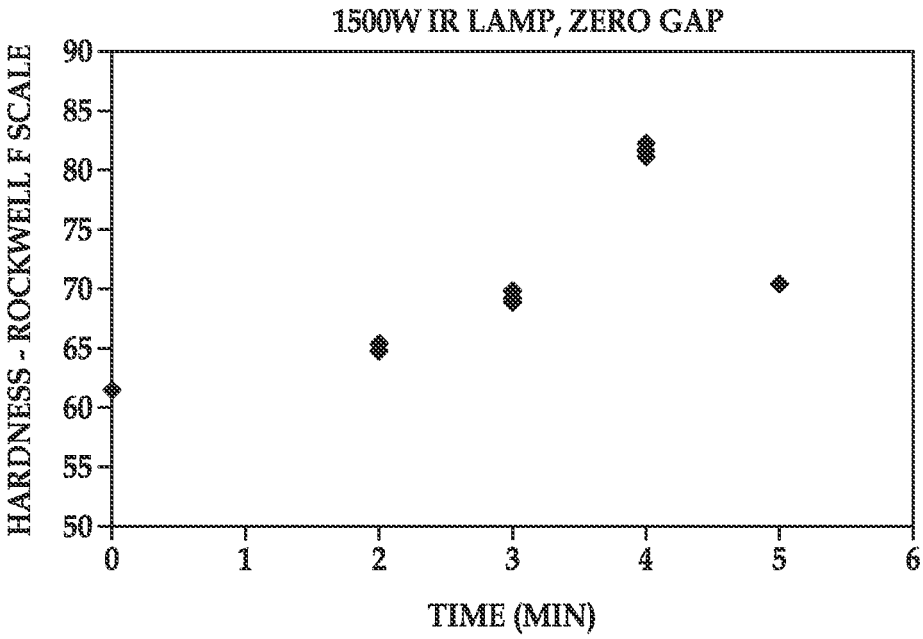
FIG. 8 is a graph plotting Rockwell F hardness as a function of heating time for the aluminum sample heated with the zero gap profile shown in FIG. 7.

Rockwell F hardness of the zero-gap aluminum sample of was measured over time. The results are shown in FIG. 8. This graph plots the time of exposure to the IR lamp (in minutes) against the measured Rockwell F hardness of the samples. The graph shows that hardness of the material increases over time, reaching a peak at approximately 4 minutes and then declining as time goes on. From these results, it may be concluded that with the 1500 W lamp, 4 minutes at "zero" gap is needed to maximize the strength of a local portion of an aluminum sample. It can also be concluded that heating for longer times under these conditions caused the alloy to over-age, which is undesirable. By applying the heat for 4 minutes, the temperature increased consistently during exposure and only exceeded 300° C. for less than 1 minute. As shown in FIG. 8, the strength of the exposed portion of the sample increased quickly around the 4 minute mark, when the temperature of the metal portion ranged from 300° C. to 325° C.

Example 2

Figure 9:
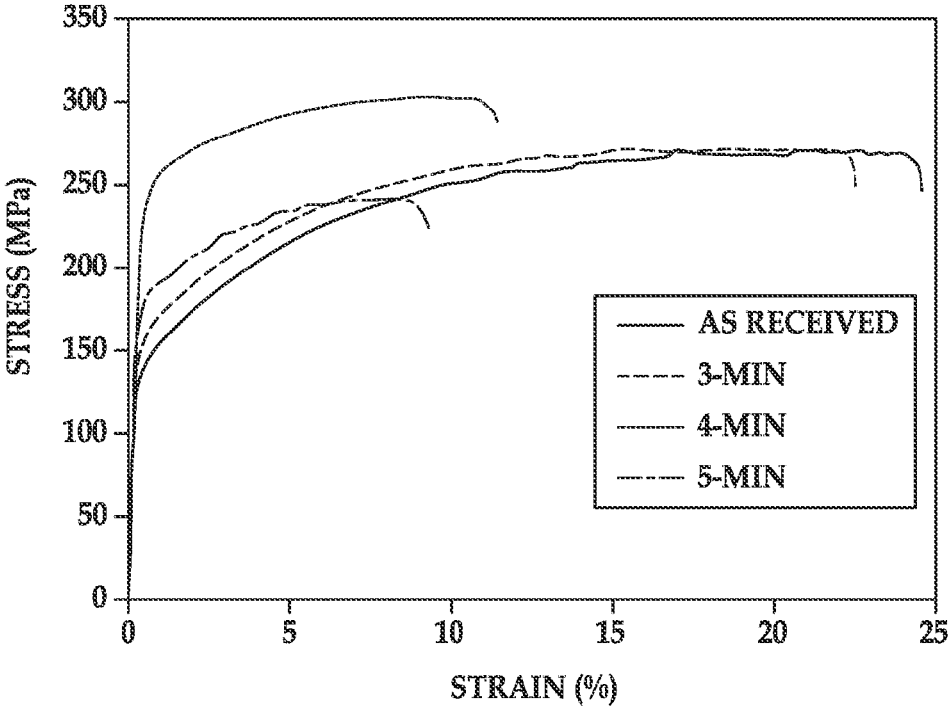
FIG. 9 is a graph depicting stress as a function of strain for aluminum samples heated for various times with the zero gap profile shown in FIG. 7.

Aluminum (AA6111) tensile bars were similarly heat treated with a 1500 watt IR lamp with a zero gap between the heat source and the aluminum bars for 3, 4, and 5 minutes. FIG. 9 is a graph which plots strain (a deformation percentage, unitless) against stress (in MPa) for each of the heat treated bars, and for the as-received (non-heated treated) bar. The 3-minute heated bar showed only a slight increase in strength compared to the initial condition. The 4-minute bar showed significant strengthening due to precipitation, such that the yield strength increased from 140 MPa to 230 MPa. The 5-minute bar showed slight strengthening compared to the original condition but was significantly softened compared to the 4-minute bar. This suggests that the 5-minute bar was over-aged. These results agree with the hardness data shown in FIG. 8 and illustrate that a panel formed of the same type of aluminum achieves desirable stress-strain results when heated for at least 4 minutes under similar conditions.

Example 3

Figure 10:
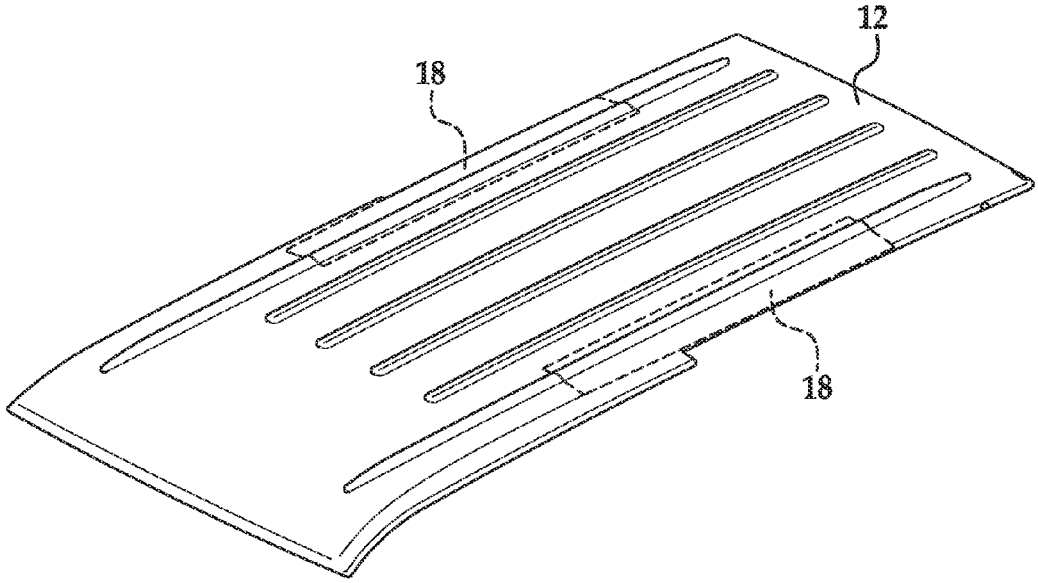
FIG. 10 is a schematic perspective representation of a computer-aided engineering (CAE) analysis of an aluminum alloy roof panel showing areas where local heat treatment, according to an embodiment of the method disclosed herein, was applied to increase yield strength.
Figure 11:
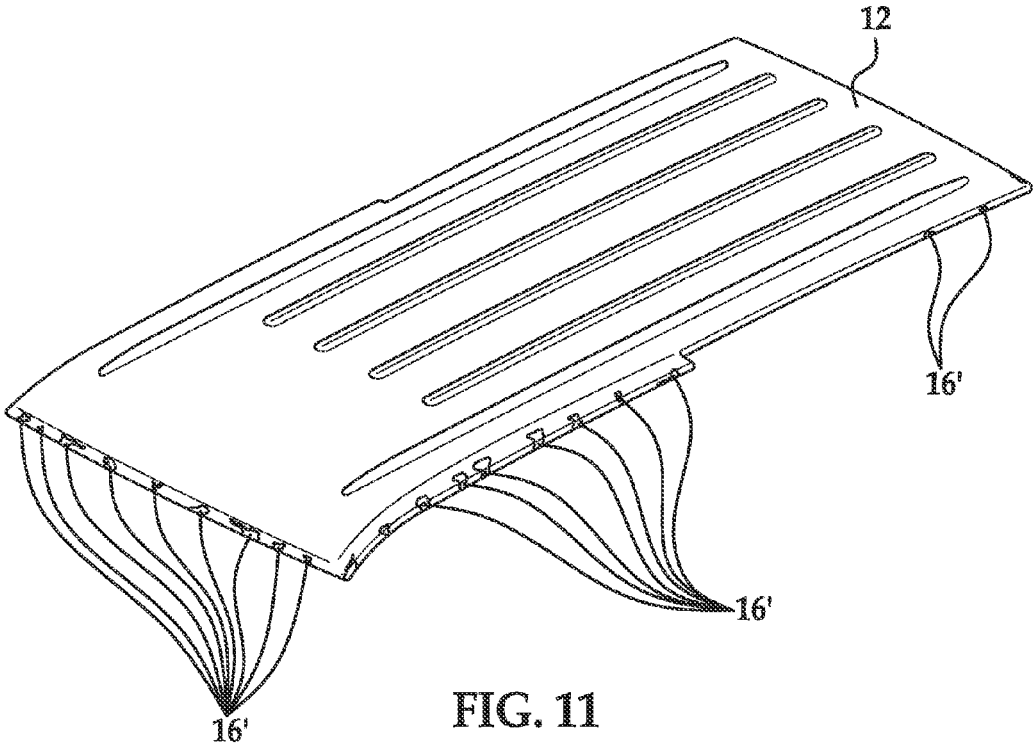
FIG. 11 is a schematic perspective representation of a computer-aided engineering (CAE) analysis of an aluminum alloy roof panel showing areas of significantly improved distortion where local treatment, according to an embodiment of the method disclosed herein, was applied to increase yield strength.

Computer aided engineering (CAE) was used with the assumption that several local areas of a roof panel were strengthened to an increased yield strength of 230 MPa. FIG. 10 is a schematic representation of a CAE-generated drawing of the aluminum roof panel 12 with the 230 MPa strengthened areas 18 indicated. FIG. 11 is a schematic representation of a CAE-generated drawing of the heat-treated aluminum roof panel 12 showing plastic strain areas 16 and 16'. Comparing FIG. 3 with FIG. 11 illustrates the effect of the local heat treatment process disclosed herein to reduce plastic strain areas 16. Since local heat treatment of the areas 16' was not simulated, such areas 16' remain.

While several embodiments have been described in detail, it will be apparent to those skilled in the art that the disclosed embodiments may be modified. Therefore, the foregoing description is to be considered exemplary rather than limiting.

The invention claimed is:

1. A method of accomplishing precipitation hardening of a selected portion of a formed aluminum automotive panel, the method comprising:

performing i) a simulation of a bake cycle of a structure including the formed aluminum automotive panel, or ii) a test bake cycle of a structure including the formed aluminum automotive panel;

identifying, from the simulation or the test bake cycle, a stress contour area which is a susceptible area of the aluminum automotive panel that experiences thermal stress as a result of thermal expansion behavior, the thermal stress above a threshold value during an actual bake cycle, thereby identifying the selected portion which is smaller than the entire formed aluminum automotive panel; and prior to the actual bake cycle, locally heating the selected portion up to a predetermined temperature for a predetermined time sufficient to increase a local yield strength of the selected portion such that the increased local yield strength ranges from 150 MPa to 300 MPa.

2. The method of claim 1 wherein the formed aluminum automotive panel comprises a precipitation hardening aluminum alloy including from 0.5 weight percent to 3.0 weight percent non-aluminum metals selected from the group consisting of copper, iron, magnesium, manganese, silicon, titanium and combinations thereof.

3. The method of claim 1 wherein the formed aluminum automotive panel is selected from age-hardenable aluminum alloys selected from the group consisting of Al—Mg—Si, Al—Mg—Si—Cu, and combinations thereof.

4. The method of claim 1 wherein the predetermined temperature ranges from 180° C. to 325° C.

5. The method of claim 4 wherein the predetermined time ranges from about 15 seconds to about 30 seconds when the predetermined temperature is 325° C.

6. The method of claim 4 wherein the predetermined time ranges from about 30 seconds to about 3 minutes when the predetermined temperature is 300° C.

7. The method of claim 4 wherein the predetermined time ranges from about 1 minute to about 4 minutes when the predetermined temperature is 275° C.

8. The method of claim 4 wherein the predetermined time ranges from about 2 minutes to about 10 minutes when the predetermined temperature is 250° C.

9. The method of claim 4 wherein the predetermined time is 30 minutes or less when the predetermined temperature is 180° C.

10. The method of claim 1 wherein the simulation of the bake cycle is performed and wherein identifying the susceptible area of the formed aluminum automotive panel that experiences thermal stress above the threshold value during the bake cycle is accomplished by:

evaluating at least one of a stress contour plot of the formed aluminum automotive panel of the formed aluminum automotive panel corresponding to a modeled condition which reflects stresses during a manufacturing process of the structure including the formed aluminum automotive panel; and identifying the susceptible area as an area that surrounds a portion of the formed aluminum automotive panel where stress is beyond a predetermined threshold level.

11. The method of claim 1, further comprising applying a coating to a surface of the formed aluminum automotive panel prior to locally heating, wherein the coating is selected to increase a surface emissivity of the formed aluminum automotive panel and improve a rate of heat transfer by radiation.

12. The method of claim 11 wherein the coating is chosen from boron nitride, black paint, colored paint, and graphite powder.

13. The method of claim 1, further comprising roughening a surface of the formed aluminum automotive panel prior to locally heating.

14. The method of claim 1 wherein locally heating is accomplished using infrared radiation heating, induction heating, conduction heating, hot air convection heating, flame heating, laser beam heating, electron beam heating, microwave heating, magnetic flux heating, and resistance heating.

15. The method of claim 1 wherein the formed aluminum automotive panel is an automobile roof panel and wherein the selected portion includes an area around a rivet location in the structure including the automobile roof panel.

16. The method of claim 11 wherein the coating is chosen from boron nitride and graphite powder.

* * * * *